US005868246A

United States Patent [19]

Westfall et al.

[11] Patent Number: 5,868,246

[45] Date of Patent: Feb. 9, 1999

[54] BINGO SUPPLY CARRIER AND BINGO CARD SUPPORT

[75] Inventors: Robert W. Westfall; Morallys Lopez, both of Modesto, Calif.

[73] Assignee: RBM Products, Modesto, Calif.

[21] Appl. No.: 807,422

[22] Filed: Feb. 28, 1997

Related U.S. Application Data

[60] Provisional application No. 60/012,673, Mar. 1, 1996.

[51] Int. Cl. [6] ..... A63F 1/00; A63F 9/00

[52] U.S. Cl. ..... 206/315.1; 220/23.4; 273/148 A; 273/309

[58] Field of Search ..... 206/315.1, 561, 206/579; 220/23.2, 23.4, 23.86, 4.26, 4.27, 4.28; 273/148 A, 150, 269, 309

[56] References Cited

U.S. PATENT DOCUMENTS

| | | | |
|---|---|---|---|
| 2,152,079 | 3/1939 | Mott | 273/148 A |
| 2,784,973 | 3/1957 | Nemec | 273/309 |
| 4,790,540 | 12/1988 | Lim et al. | 273/309 |
| 4,817,809 | 4/1989 | Rozmestor | 220/23.4 |
| 4,872,550 | 10/1989 | Stranges | 206/315.1 |
| 5,054,783 | 10/1991 | Hull et al. | 273/148 A |
| 5,120,069 | 6/1992 | Shaw | 206/315.1 |
| 5,139,299 | 8/1992 | Smith | 220/23.4 |
| 5,495,947 | 3/1996 | Zarske | 206/315.1 |

*Primary Examiner*—Paul T. Sewell
*Assistant Examiner*—Luan K. Bui
*Attorney, Agent, or Firm*—Carol D. Titus; James J. Leary

[57] ABSTRACT

A carrier convertible from a carrying and storage mode to a playing mode. There are two bins which, in the carrying mode, are positioned on either side of one or more boards. The bins interlock with each other and with the boards so that the whole device may be easily carried as a unit. The interlock may be formed from posts and holes, depressions and protrusions, etc. When a user wishes to play bingo or other similar type game, the carrier is quickly and easily converted to playing mode. The latches are disengaged to allow the two bins to separate. This frees the boards from their confinement by the interlock. There is a groove in the backs of the boards. When the boards are set up for play, the grooves are set to rest over and engage either the low front edge of the bins, or the higher back edge of the bins. In this position, the boards provide an inclined surface for holding and displaying multiple bingo cards for convenient viewing and playing.

19 Claims, 10 Drawing Sheets

BINGO SUPPLY CARRIER AND BINGO CARD SUPPORT

RELATIONSHIP TO OTHER APPLICATIONS

This application claims the benefit of U.S. Provisional Application No. 60/012,673, filed Mar. 1, 1996.

FIELD OF INVENTION

The present invention relates generally to a device for carrying and playing games. More particularly it relates to a carrier for holding playing supplies and boards. This carrier is especially useful for bingo.

BACKGROUND OF THE INVENTION

The game of bingo has become almost a national pastime. For many it is more than a pastime, it is an important part of every week, or even every day. Most people who play the game play multiple cards during any particular round. This can be very difficult to do if you have a limited amount of space. It can also be difficult to track and mark all of your cards as the numbers are called. This is especially true in cases where the cards are flat on the table and/or not close enough to you.

SUMMARY OF THE INVENTION

In keeping with the foregoing discussion, the objective of the present invention is to provide a simple, economical device that can carry bingo supplies and provides a way to support bingo cards at an angle such that the player may easily see all the cards he or she is playing, thereby making it less likely to miss numbers on a card that correspond to called numbers.

In keeping with these objectives, the present invention takes the form of a carrier which is convertible from a carrying and storage mode to a playing mode. There are two bins which, in the carrying mode, are positioned on either side of one or more boards. The bins are designed to connect to one another as well as to hold the boards in place. This is done in any number of ways.

In a first embodiment, each of the bins has, on its back, a pin on one side and a hole on the other side, and each of the boards has two holes in its base. When the device is assembled in carrying mode, the pins on the bins go through the holes in the boards and then into the hole of the other bin. There are two latches which connect the ends of the two bins together. Once the bins and boards are in place, the two latches are hooked together. This locks the device into a single compact unit for carrying and storage. The unit may be carried by the handle(s) which are connected to some or all of the tops of the boards. Bingo supplies such as card markers, cards, pencil, paper etc. may be stored in the bins.

In a second embodiment, the pins and holes are replaced by protrusions and depressions. A third embodiment uses indentations in the sides of the board at the location of the latches. Each latch is located in the indentation thereby preventing the board from moving.

When a user wishes to play bingo or other similar type game, the carrier is quickly and easily converted to playing mode. The latches are disengaged to allow the two bins to separate. This frees the boards from their confinement. There is a groove in the backs of the boards. When the boards are set up for play, the grooves are set to rest over and engage either the low front edge of the bins, or the higher back edge of the bins. In this position, the boards present an inclined playing surface for placement of the bingo cards. Other objects and advantages of the invention will no doubt occur to those skilled in the art upon reading and understanding the following detailed description along with the accompanying drawings.

DETAILED DESCRIPTION OF THE INVENTION

Figure 1:
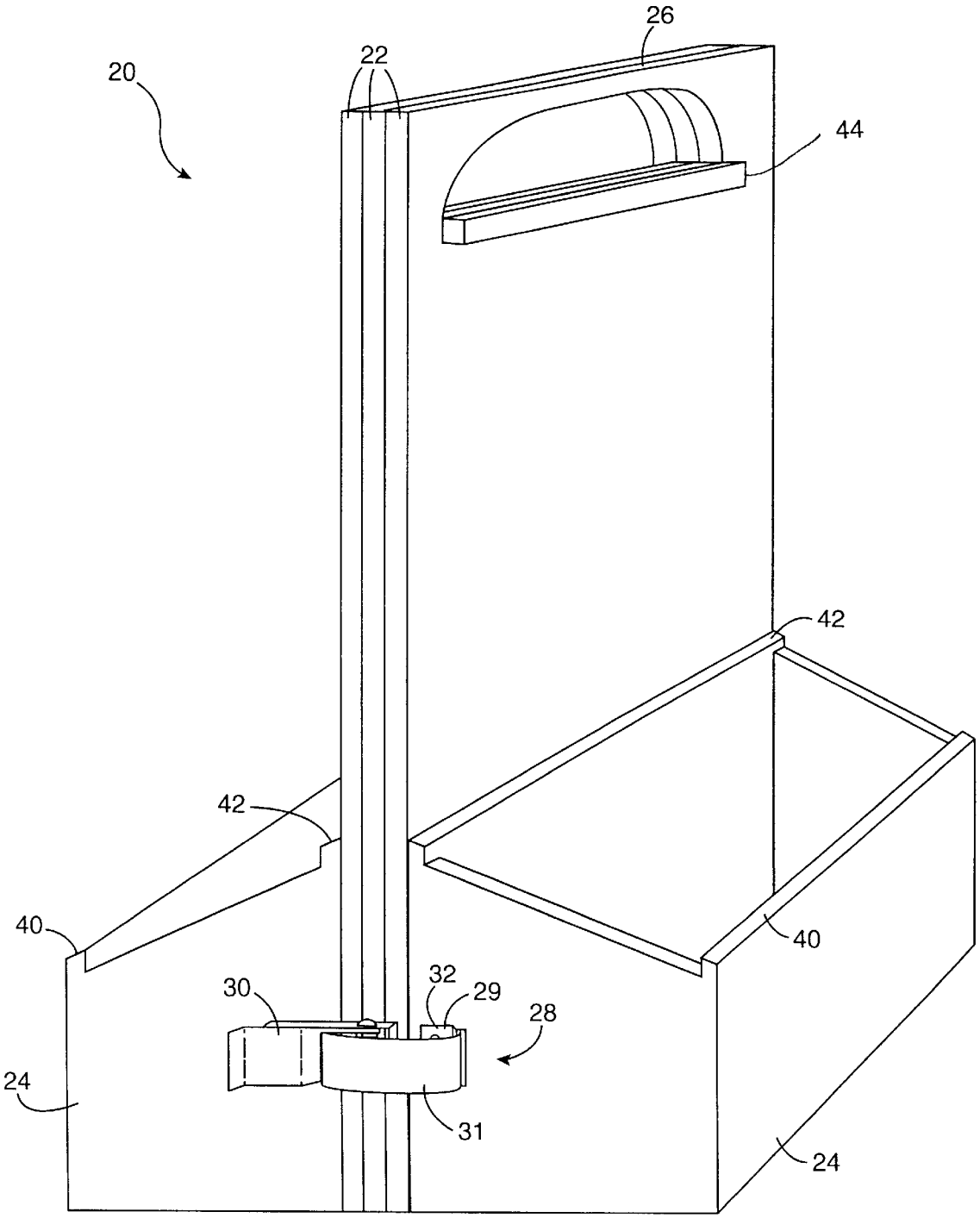
FIG. 1 is a perspective view of the carrier in its assembled storage position.

FIG. 1 is a perspective view of the carrier 20 in its assembled storage position. In this position, the user can easily carry the boards 22, bins 24, and their contents by the handles 26 which are located on the tops of the boards 22. This version of the carrier 20 has been specifically designed for ease of manufacturing. There are two bins 24 which are identical. Each bin 24 has one half 30 of a latch 28 on one end and the corresponding half 32 of the latch 28 on the other end. On the back of each bin 24 there is a post 34 on one side and hole 36 on the other. Each of the boards 22 is made with a handle 26 on the top and a groove 38 (seen in FIG. 2) on the back side of the bottom end of the board 22. The groove 38 is sized to retain the front 40 or back 42 wall of the bin 24 such that the user can rest the board 22 securely against the bin 24 at an angle. This also allows the bingo card, which is resting against the ledge 44 on the front of the board 22, to be easily seen.

This design may be formed from virtually any material, such as wood, plywood, metal, plastic, or if a disposable version were desired, cardboard. In the three embodiments described herein, the device is formed from only two different pieces. This is a great benefit and allows the device to be mass manufactured. Optimally, a molded plastic design, either injection molded or blow molded, would be used.

In alternate designs, there may be a single handle on one of the boards 22. There may be different latches 28 used, or other modifications made.

Figure 2:
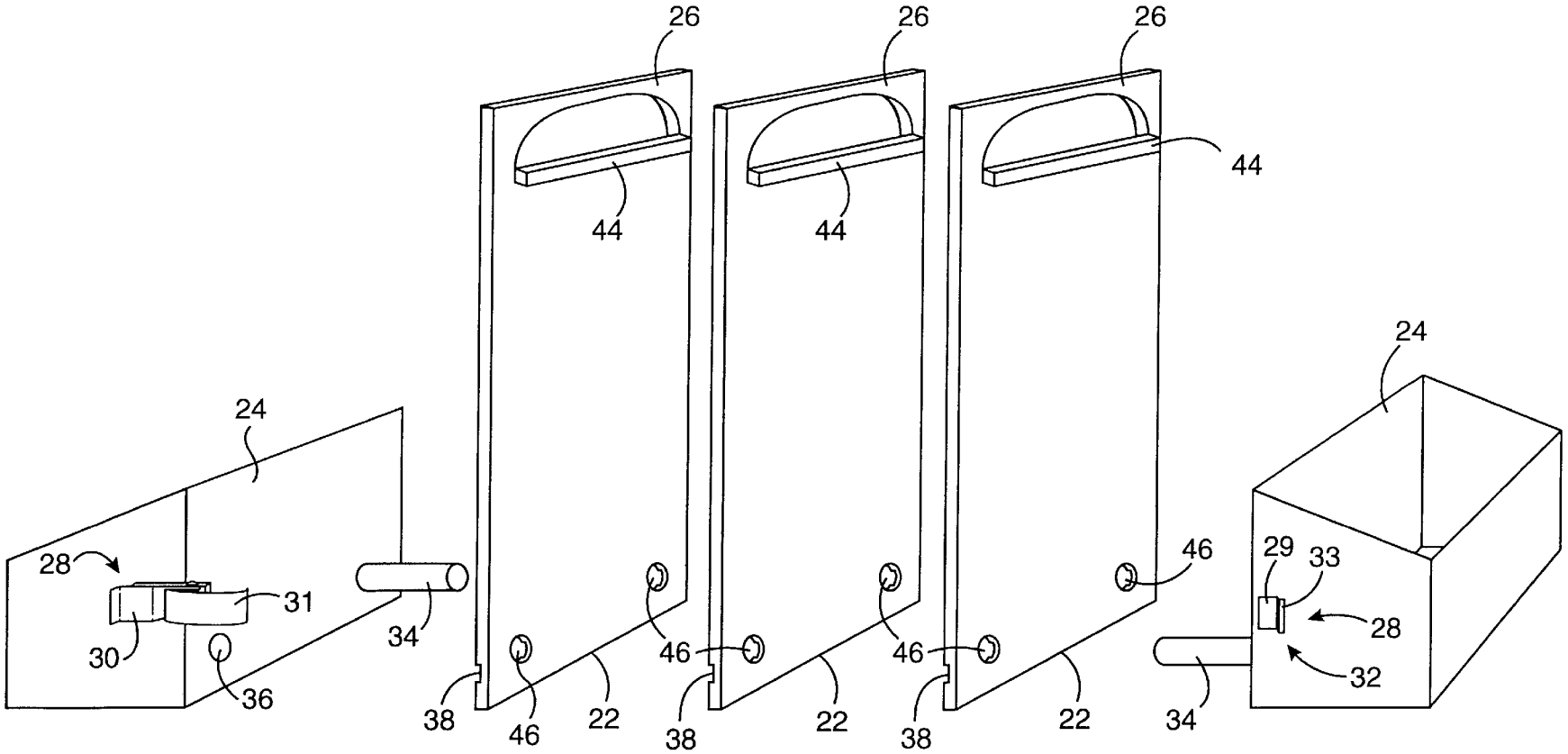
FIG. 2 is an exploded perspective view of the carrier.

FIG. 2 is an exploded perspective view of the carrier 20. This shows how the carrier 20 is put together or comes apart. On the back of each bin 24, there is a post 34 and a hole 36 which are a identical on both bins 24 such that when the bins 24 are placed back-to-back the post 34 from one bin 24 is lined up with the hole 36 from the other bin 24. The posts 34 from both bins 24 go through holes 46 which are in the bottom of the boards 22. This securely holds the boards 22 in place when the carrier 20 is latched. The latch 28 in this case is a toggle-type latch 28. In this illustrative embodiment, the toggle latch 28 has a metal arc 31 attached to one bin 24. When the latch 28 is to be secured, the lever 30 is lifted, the arc 31 is hooked over the projection 33 on the post 29. Then the lever 30 is pressed down to lock the latch 28. There is also a ledge 44 on the handle end of each of the boards 22. On the back side of the boards is a corresponding indentation 48 (seen in FIG. 6A). The projecting ledge 44 gives the bingo cards a secure surface to rest against in playing mode. The combination of the ledge 44 and the indentation 48 forms an interlock at the handle ends of the boards 22 when the carrier 20 is assembled. When the boards are stacked front-to-back, and the holes 46 are aligned, the ledge 44 from one board 22 fits into the indentation 46 in the next board 22. This provides a second interlock when the carrier 20 is assembled. It also provides an easy way to align and hold the boards 22 in place during assembly of the carrier 20.

Figure 3:
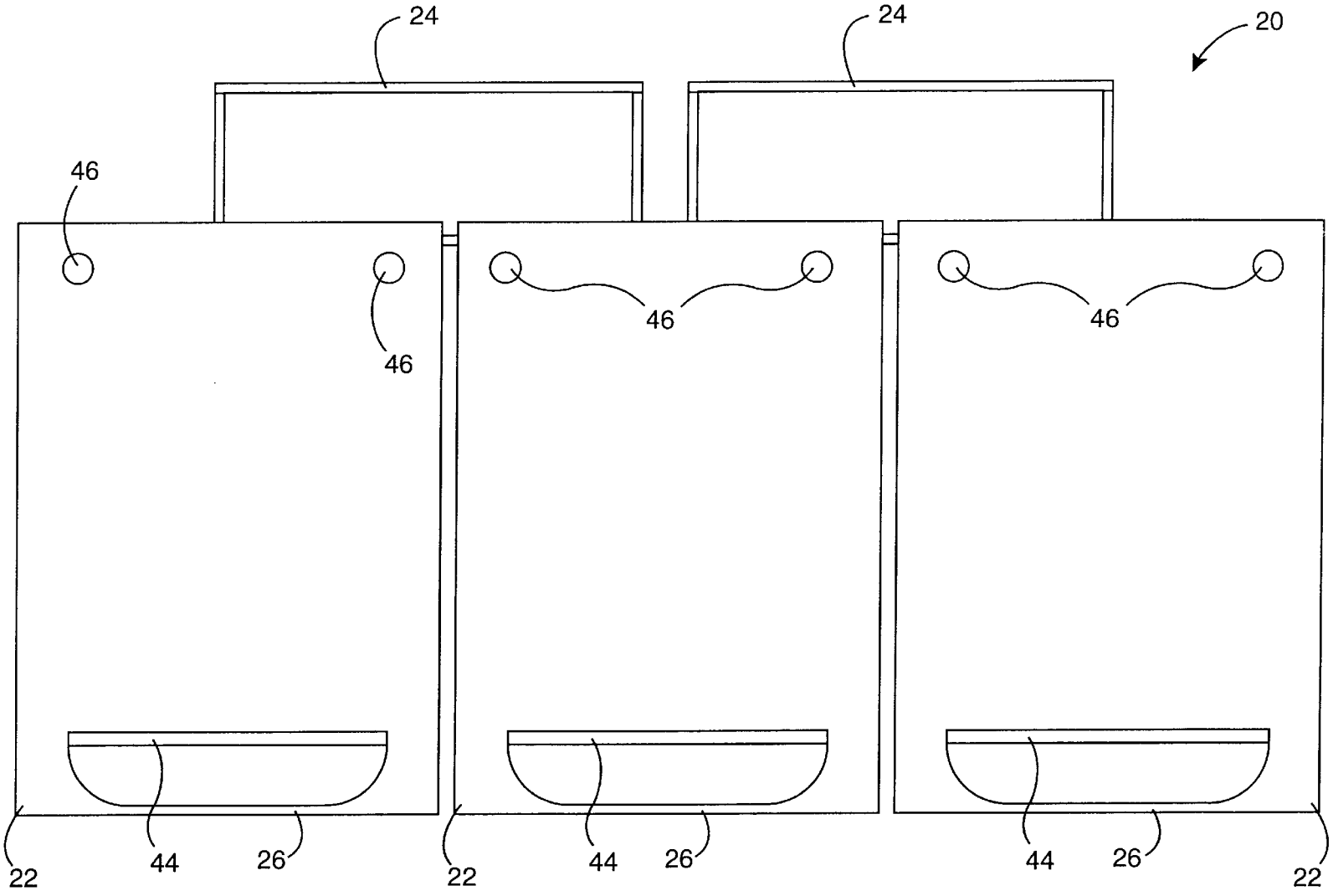
FIG. 3 is a view of the carrier in use to hold three cards for player viewing.

FIG. 3 is a top view of the carrier 20 in playing mode. In this case, three boards 22 are inclined against either the front 40 or back 42 wall of the bins 24. At this point, bingo cards may be placed against the ledges 44 at the handle ends of the boards 22. This places the cards in a position for optimal viewing and playing. In this configuration, three cards may easily be played. If desired, the bingo cards may be placed closer together such that extra cards may be placed across the boards 22 and played. If fewer bingo cards are to be played, two boards 22 or even a single board 22 may be used.

Figure 4A:
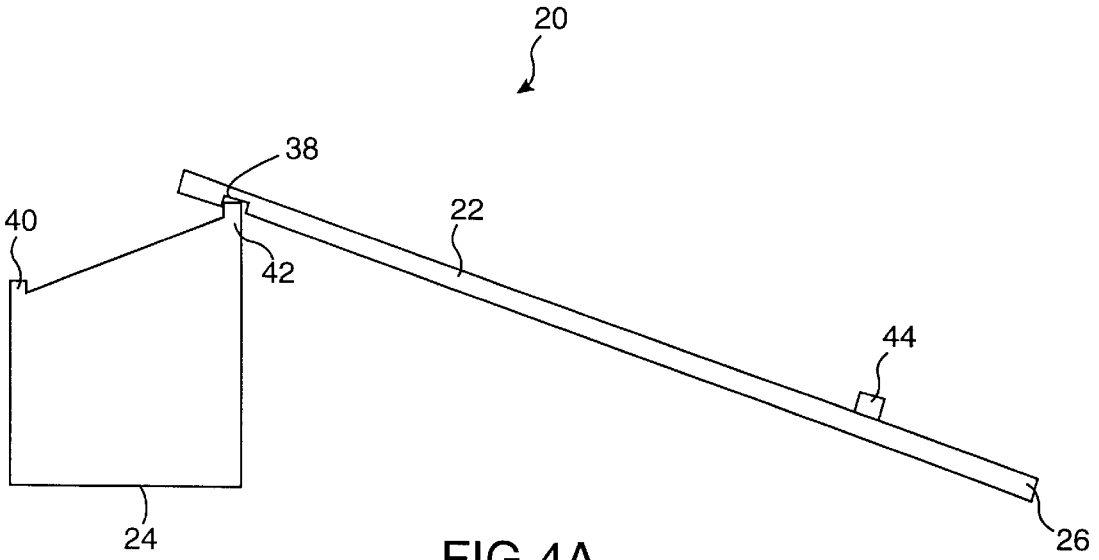
FIG. 4A is a side view of the engagement between the board and bin on the higher back side.
Figure 4B:
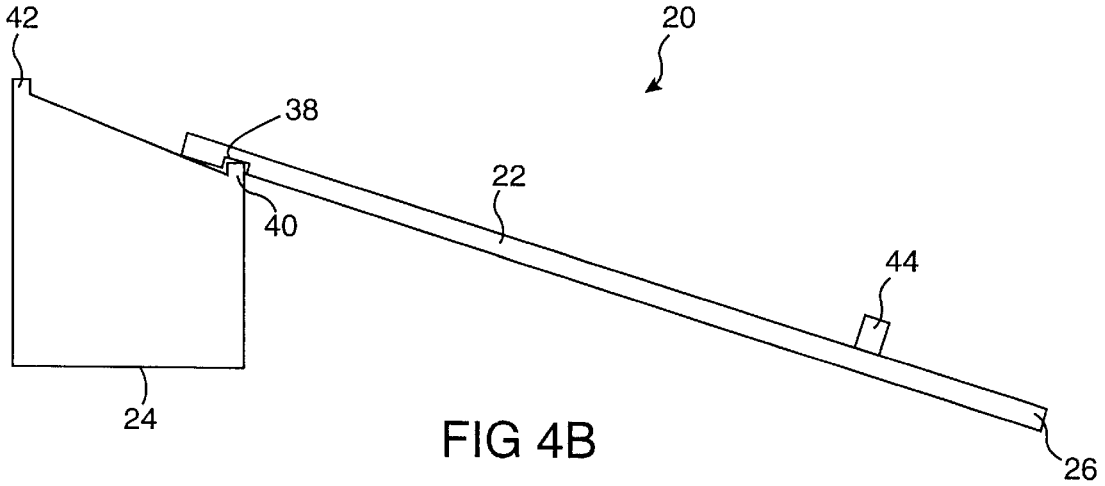
FIG. 4B is a side view of the engagement between the board and bin on the lower front side.

FIGS. 4A and 4B are side views of the engagement between the boards 22 and bins 24 in playing mode. The groove 38 in the back of the board 22 is sized to fit the top of either the front 40 or the back 42 wall of the bin 24. FIG. 4A shows a board 22 resting on the back edge 42 of the bin 24. The back edge 42 of the bin 24 is relatively tall. This creates a relatively large angle between the board 22 and the table the device is resting on. This brings the playing cards into a more upright viewing angle for the player. FIG. 4B shows the board 22 resting on the front edge 40 of the bin 24. The front edge 40 of the bin 24 is lower than the back edge 42. This creates a smaller angle between table and board 22. This brings the playing cards into a viewing angle intermediate to flat on the table and the more upright angle of FIG. 4A. In different situations, a user may wish to have a choice in the angle at which they view their cards. In some situations, depending on the height of the table and chair, it may be desired to have the angle between table and board 22 change to achieve the same angle of view, or different angles of view for different users.

Figure 5:
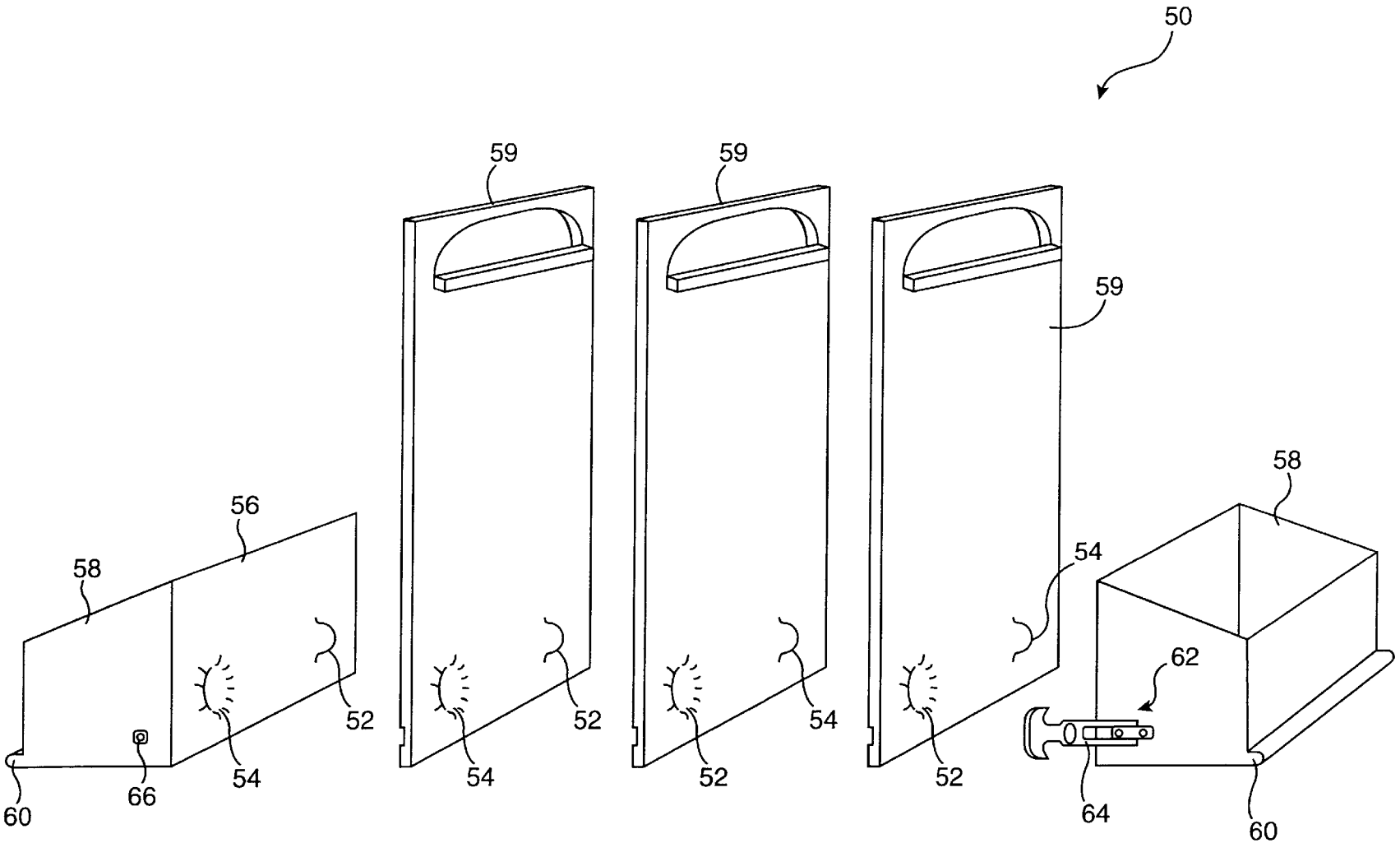
FIG. 5 is an exploded perspective view of a second embodiment of the carrier.

FIG. 5 is an exploded perspective view of a second embodiment of the carrier 50. The second embodiment 50 has protrusions 52 and corresponding indentations 54 in the back walls 56 of the bins 58 and in the boards 59. These protrusions 52 and indentations 54 perform the same function as the holes 36 and posts 34 in the first embodiment.

This embodiment is especially useful if the bins 58 will be used with smaller objects that could potentially fall through holes. The indentations 54 and protrusions 52 of the second embodiment 50 do not require throughholes, merely a deformation of the boards 59 and the back walls 56 of the bins 58. Additionally, there are no extreme protrusions that could inadvertently catch on a person passing by and upset the device 50 while it is being used in playing mode.

Ledges 60 are located on the lower front edge of each of the bins 58. These ledges 60 add further stability to the bingo carrier 50, both when assembled in carrying mode, and when in playing mode, particularly in use in the low angle playing position.

In the second embodiment, the latch 62 is formed of a elastomeric loop 64 attached to one of the bins 58. This loop 64 may be stretched over a projection 66 which is attached to the second bin 58. Other geometries of the elastomeric latch 62 are possible. This latch 62 allows the user to choose how many boards 59 he or she would like to play each time the carrier 50 is to be used. The more boards 59 used, the further the loop 64 will be stretched.

Figure 6A:
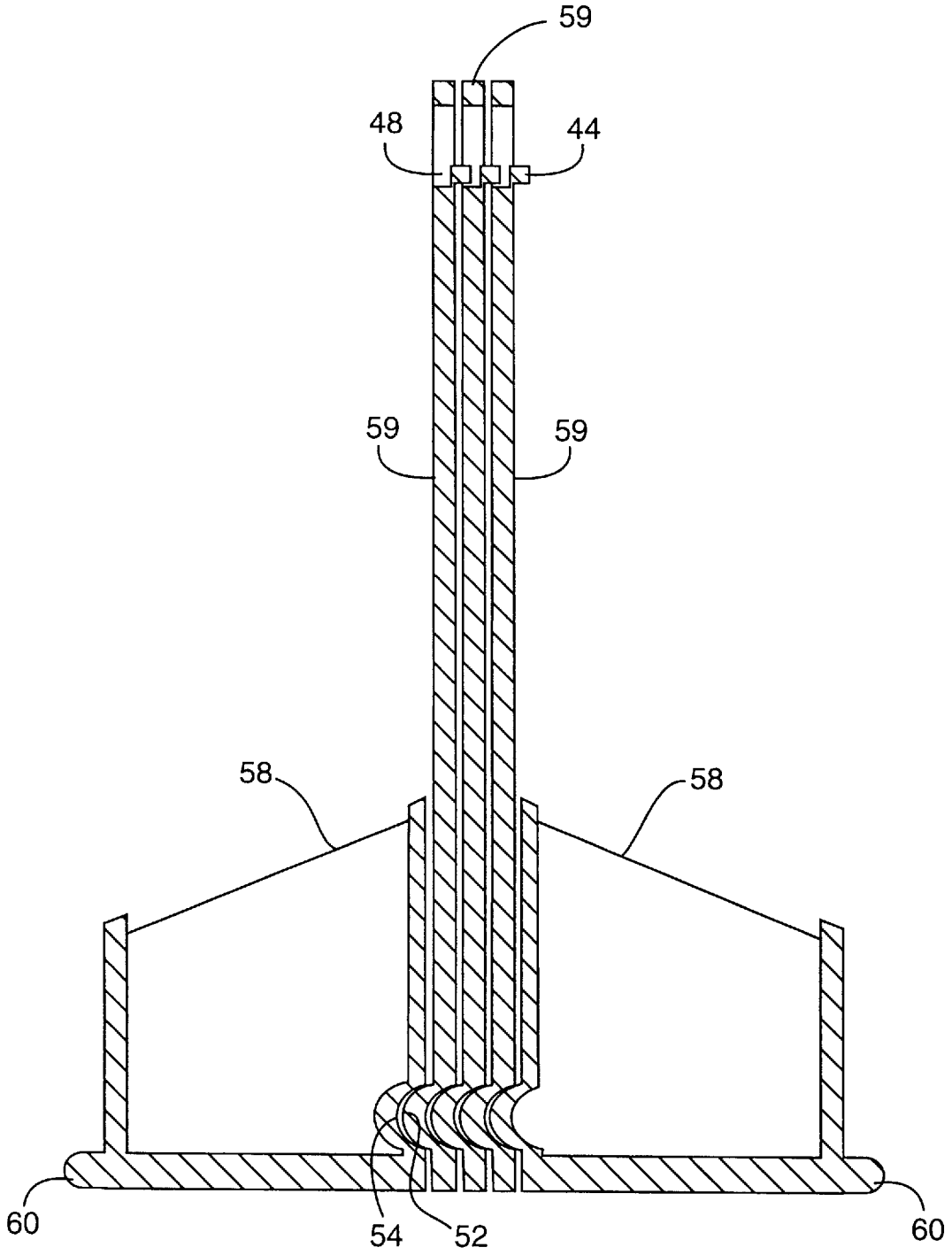
FIG. 6A is a cross-sectional view of the carrier showing the engagement between the bumps and indents in the bins and boards.
Figure 6B:
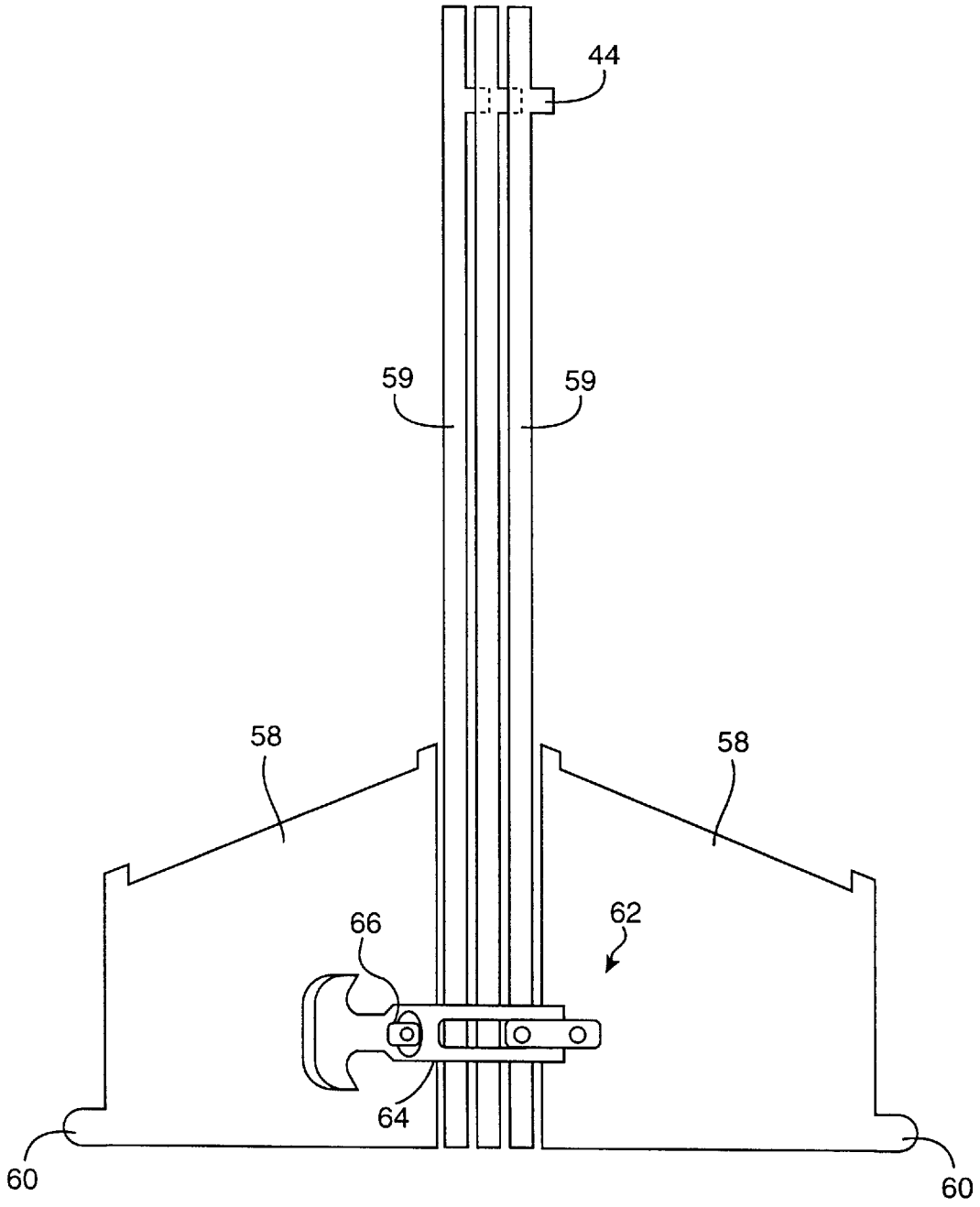
FIG. 6B is a side view of the second embodiment of the carrier.

FIG. 6A is a cross-sectional view and FIG. 6B is a side view of the carrier 50. FIG. 6A shows the engagement between the projections 52 and indentations 54 in the bins 58 and boards 59. Also apparent is the engagement between the ledge 44 from one board 59 and the indentation 48 in the back of the next board 59. FIG. 6B shows the loop 64 of the latch 62 in place over the corresponding projection 66.

Figure 7:
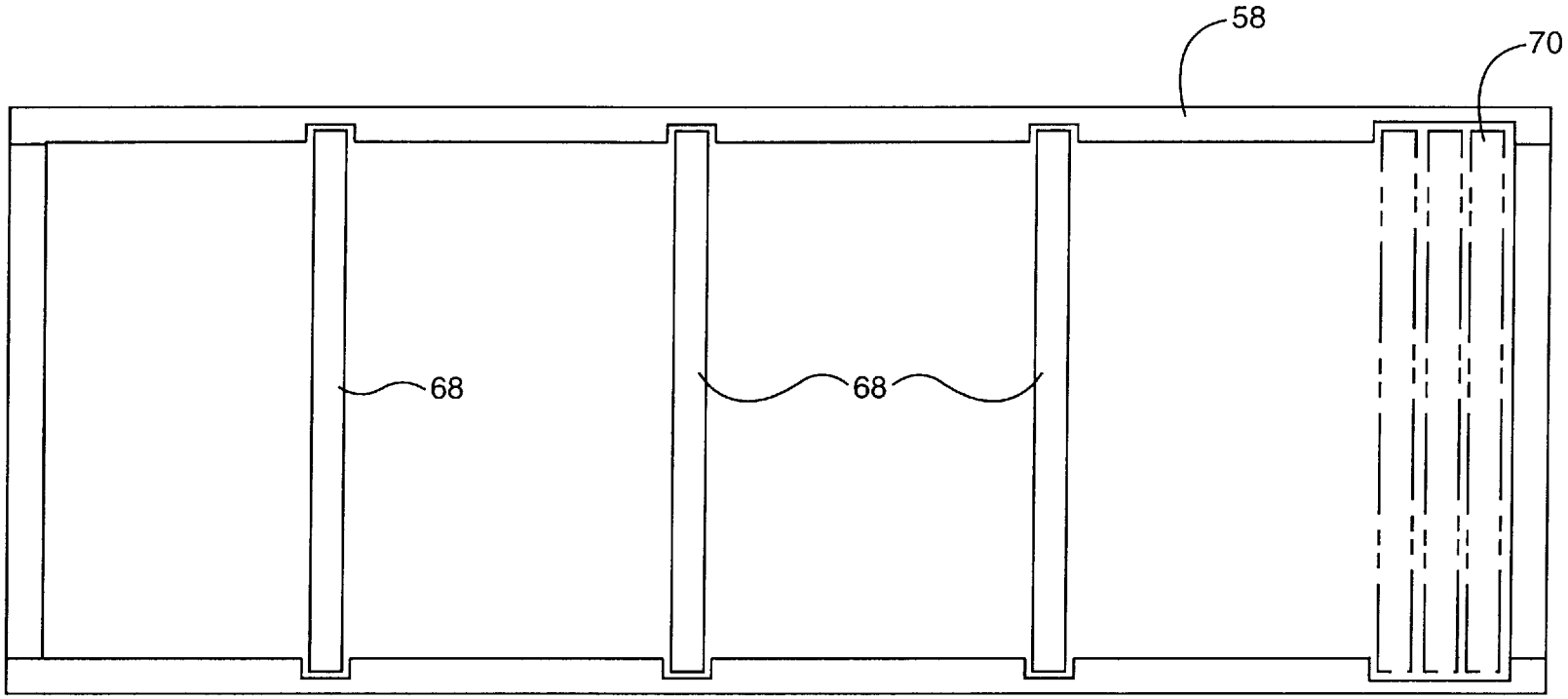
FIG. 7 is a top view of one of the bins showing dividers which may be used to separate the bin into multiple compartments.

FIG. 7 is a top view of one of the bins 58 showing dividers 68 which may be used to separate the bin 58 into multiple compartments. Differing configuration for the two different bins 58, or for different uses may be desired. The phantom lines 70 show how the dividers 68 may be stored at one end if the user wishes to have one large compartment.

Figure 8:
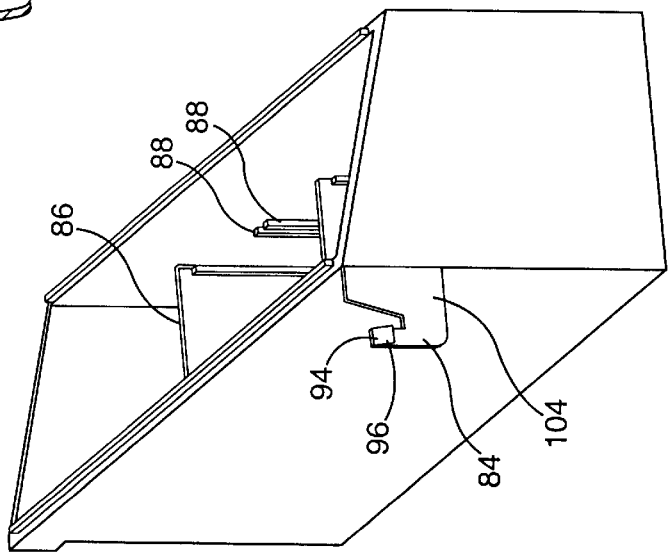
FIG. 8 is a perspective view of a bin of a third embodiment of the carrier.

FIG. 8 is a perspective view of the bin 82 of a third embodiment of the carrier 80. In this embodiment 80, hooks 84 project from one edge of the rear side of each bin 82. The interlock of the bins 82 will be more fully described later. The dividers 86 for the bins 82 are held in place by pairs of projections 88 which extend outward from the inside of the sidewalls of each bins 82. This configuration makes the mold making and molding processes simpler and less expensive, as well as adding strength to the bins 82.

Figure 10:
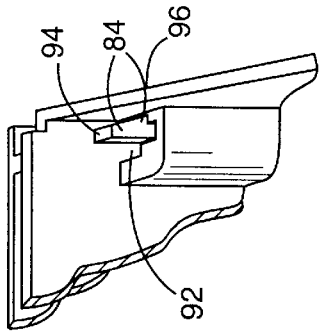
FIG. 10 is a close-up cut-away view of the interlock of the bins.
Figure 9:
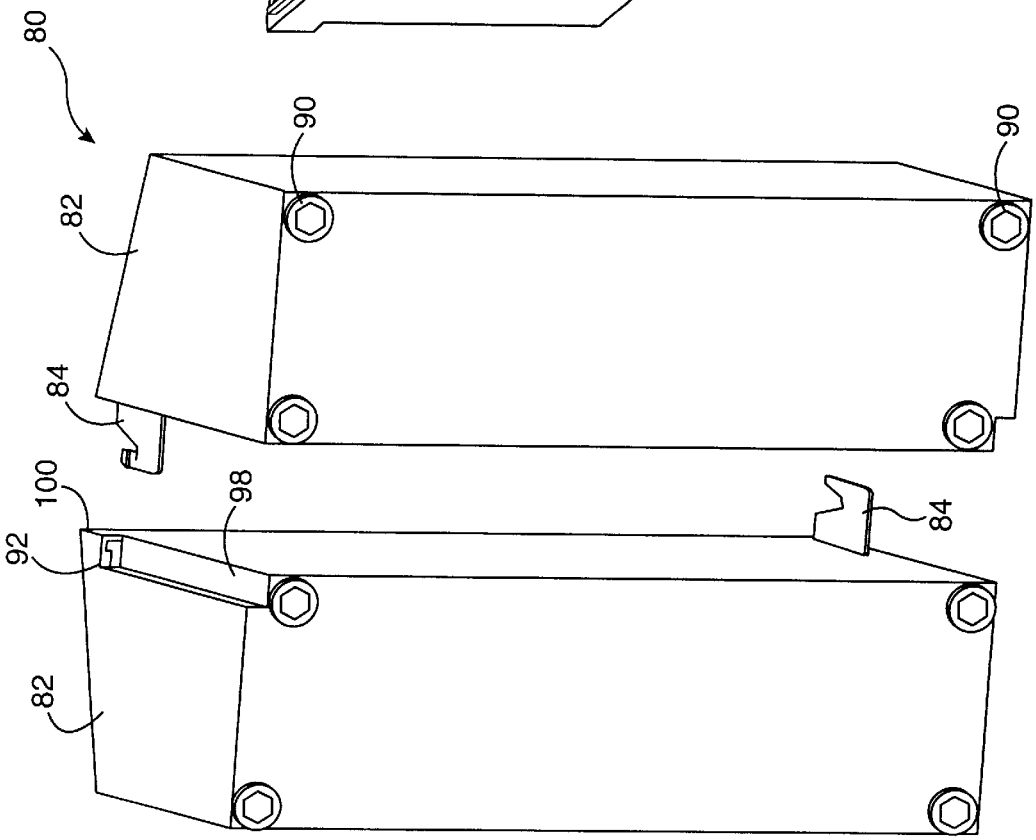
FIG. 9 is a bottom perspective view of the bins of the third embodiment.

FIG. 9 is a bottom perspective view of the bins 82 of the third embodiment 80. In order to alleviate any potential problems with the bins 82 sliding on smooth surfaces, rubber or other traction feet 90 may be added to the bottom surface of the bins 82. The interlock between the two bins 82 in this embodiment 80 is formed by a hook 84 projecting from the back of one side of the bin 82 and a depression and/or hole 92 in the corresponding side of the other bin 82. The top 94 of the hook 84 has a widened section 96 which locks the two bins 82 to one another, as seen in FIG. 10. In order to release the two bins 82, the user must press the top portion or tab 94 on the tip of the hook 84, thereby disengaging the interlock between the two bins 82. The simplest form of the depression in the other side of the bin is to form an indentation 98 in the corner of the bin 82, leaving only a short portion 100 of the corner extended. On the bottom of the extended section 100 is the hole 92 through which the tab 94 extends. The section 104 of the hook 84 which connects to the bins 82 is of a width to match indentations 102 in the boards 106 of this embodiment 80.

Figure 11:
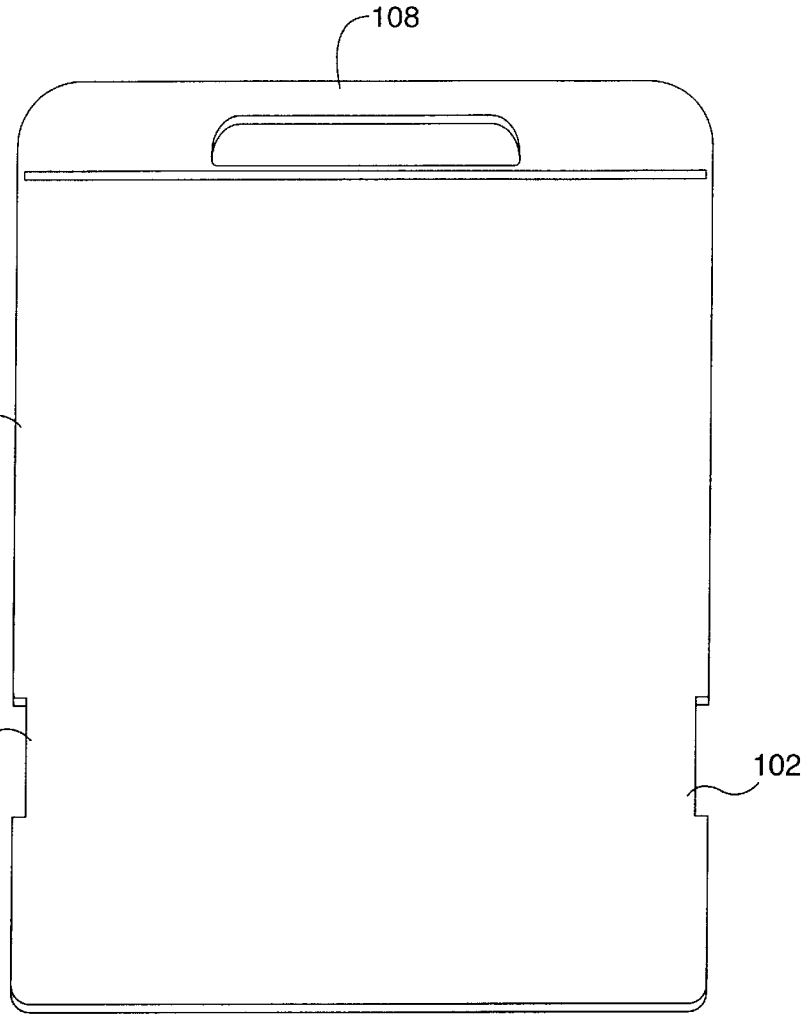
FIG. 11 is a front-bottom view of a board of the third embodiment.
Figure 12:
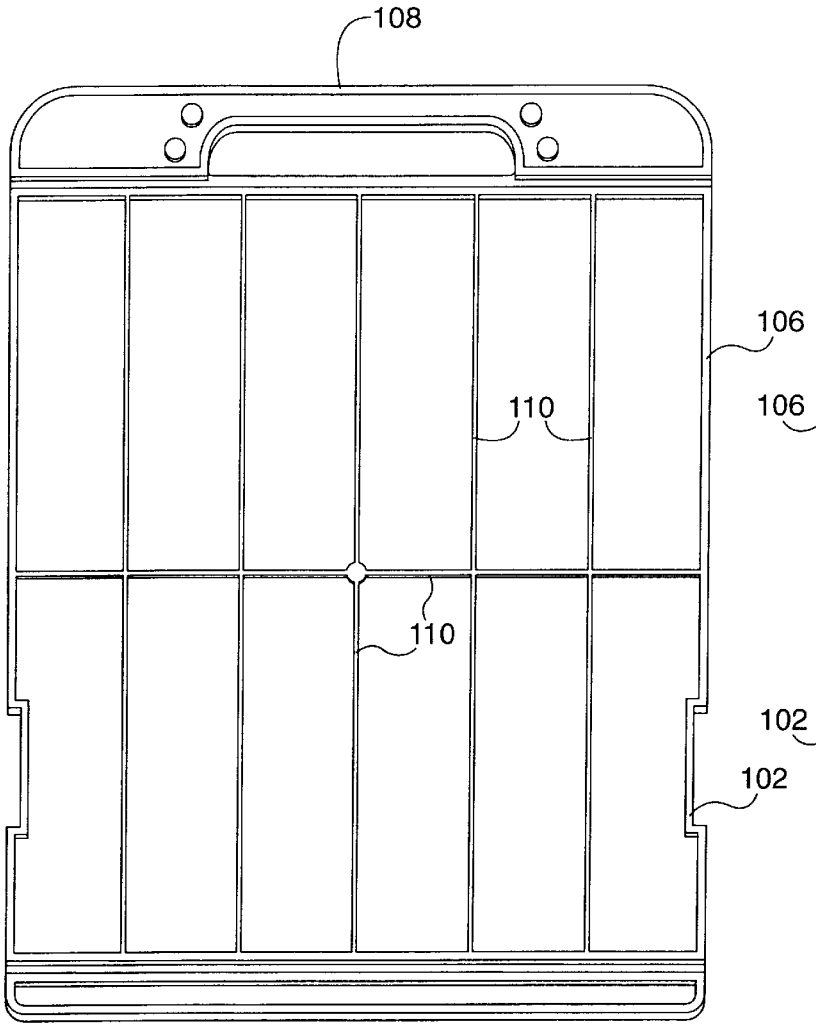
FIG. 12 is a back-bottom view of a board of the third embodiment.

FIG. 11 is a front-bottom view and FIG. 12 is a back-bottom view of a board 106 of the third embodiment 80. The sides of each board 106 of the present embodiment have an indentation 102 on either edge. When assembled, the hooks 84 of the bins 82 are located within these indentations 102. The hooks 84 hold the boards 106 in place and allow the user to carry the carrier 80 by the handle 108 in the boards 106 without worrying about losing the bins 82 and their cargo. The back of the board 106 is partially hollowed. The ribs 110 give the board 106 greater strength and resistance to twisting and bending.

Currently the carrier pieces are molded from a plastic such as ABS or styrene. However, other plastics or any material which is reletively sturdy and durable such as wood and metal may also be used.

Although the examples given include many specificities, they are intended as illustrative of only one possible embodiment of the invention. Other embodiments and modifications will, no doubt, occur to those skilled in the art. For example any number of latches may be used. Three examples have been given, but any latch which may be mounted to the two bins could be used. Even a strap and buckle or hook-and-loop fasteners would be a suitable latching mechanism. Additional features could also be add. For example covers could be made to fit the bins. These cover(s) could be a separate piece, or they could be hingedly attached to the bins. Thus, the examples given should only be interpreted as illustrations of some of the preferred embodiments of the invention.

I claim:

1. A carrying and support device for bingo, comprising:

a first bin and a second bin, at least one board, an attachment means for attaching said first bin, said second bin and said at least one board together, a projection on a front edge or a back edge of at least one of said first bin and said second bin, and an indentation in a backside of said at least one board, wherein said device has a first position, wherein when in said first position said attachment means holds said at least one board between said first bin and said second bin, wherein said device has a second position, wherein when in said second position said at least one board is at least partially supported by at least one of said first bin and said second bin and wherein when in said second position said projection is at least partially located within said indentation.

2. The carrying and support device of claim 1 further comprising divider members, said divider members interlocking within at least one of said first bin and said second bin.

3. The carrying and support device of claim 1 wherein said at least one board is at least two boards.

4. The carrying and support device of claim 3 further comprising a projection located on a front surface of each of said at least two boards proximate an edge of each of said at least two boards and a corresponding indentation located on a back side of each of said at least two boards proximate said edge.

5. The carrying and support device of claim 1 wherein said attachment means attaches a first side of said first bin to a second side of said second bin and a second side of a first bin to a first side of a second bin and holds said at least one board between a back side of said first bin and a back side of said second bin.

6. The carrying and support device of claim 5 wherein said first bin and said second bin are identically configured.

7. The carrying and support device of claim 1 wherein a top portion of said at least one board forms a handle.

8. A carrying and support device for bingo, comprising:

a first bin and a second bin, each of said bins having a top opening, at least one board, an attachment means for attaching said first bin, said second bin and said at least one board together, and a handle means for holding said carrying and support device, wherein said device has a first position, wherein when in said first position said attachment means holds said at least one board between said first bin and said second bin, wherein said device has a second position, wherein when in said second position said at least one board is at least partially supported by at least one of said first bin and said second bin, and wherein said top openings of said first bin and said second bin are accessible in said first position and said second position.

9. The carrying and support device of claim 8 wherein said at least one board is at least two boards and further comprising a projection located on a front surface of each of said at least two boards proximate an edge of each of said at least two boards and a corresponding indentation located on a back side of each of said at least two boards proximate said edge.

10. The carrying and support device of claim 8 wherein said attachment means is chosen from a group consisting of latches, straps, hooks and interlocking members.

11. The carrying and support device of claim 8 further comprising an interlocking means for interlocking said at least one board, said first bin and said second bin, wherein said interlocking means hinders relative motion between said at least one board, said first bin and said second bin of said device.

12. A carrying and support device for bingo, comprising:

a first bin and a second bin, at least one board, an attachment means for attaching said first bin, said second bin and said at least one board together, a handle means for holding said carrying and support device, and an interlocking means for interlocking said at least one board, said first bin and said second bin, wherein said interlocking means hinders relative motion between said at least one board, said first bin and said second bin of said device, wherein said interlocking means comprises at least one projection and at least one indentation, wherein said device has a first position, wherein when in said first position said attachment means holds said at least one board between said first bin and said second bin, and wherein said device has a second position, wherein when in said second position said at least one board is at least partially supported by at least one of said first bin and said second bin, and wherein when in said first position said at least one projection is located within said at least one indentation.

13. The carrying and support device of claim 12 wherein said at least one board is at least two boards and further comprising a projection located on a front surface of each of said at least two boards proximate an edge of each of said at least two boards and a corresponding indentation located on a back side of each of said at least two boards proximate said edge.

14. A carrying and support device for bingo, comprising:

a first bin and a second bin, at least one board, an attachment means for attaching said first bin, said second bin and said at least one board together, and a handle means for holding said carrying and support device, wherein said device has a first position, wherein when in said first position said attachment means holds said at least one board between said first bin and said second bin, wherein said device has a second position, wherein when in said second position said at least one board is at least partially supported by at least one of said first bin and said second bin, and wherein said attachment means attaches a first side of said first bin to a second side of a second bin and a second side of said first bin to a first side of said second bin, and wherein said first side of said first bin is configured the same as the first side of said second bin and said second side of said first bin is configured the same as the second side of said second bin.

15. A carrying and support device for bingo, comprising:

a first bin and a second bin, at least one board, an attachment means for attaching said first bin, said second bin and said at least one board together, and a handle means for holding said carrying and support device, wherein said device has a first position, wherein when in said first position said attachment means holds said at least one board between said first bin and said second bin, wherein said device has a second position, wherein when in said second position said at least one board is at least partially supported by at least one of said first bin and said second bin, wherein said first bin has a first side and a second side and said second bin has a first side and a second side, wherein said attachment means comprises a hooked-shaped projection depending from each of said first bin and said second bin and a hole located in each of said first bin and said second bin, and wherein when in said first position at least a portion of each projection is located within each hole.

16. The carrying and support device of claim 15 wherein said first bin and said second bin each have a wall and said hole extends through said wall, and wherein when in said first position a tip of each projection extends through said hole.

17. The carrying and support device of claim 16 wherein said tip of each projection has a widened section and wherein when in said first position said widened section interlocks with a perimeter of said hole.

18. The carrying and support device of claim 15 wherein said first bin has a top opening and said second bin has a top opening and wherein said top openings of said first and second bins are accessible in both said first position and said second position.

19. The carrying and support device of claim 15 wherein said at least one board is at least two boards and further comprising a projection located on a front surface of each of said at least two boards proximate an edge of each of said at least two boards and a corresponding indentation located on a back side of each of said at least two boards proximate said edge.

* * * * *